US008932103B2

(12) United States Patent
Hansen

(10) Patent No.: US 8,932,103 B2
(45) Date of Patent: Jan. 13, 2015

(54) POST-OPERATIVE BRASSIERE

(76) Inventor: Doris Hjorth Hansen, Chiaverano (IT)

( * ) Notice: Subject to any disclaimer, the term of this patent is extended or adjusted under 35 U.S.C. 154(b) by 226 days.

(21) Appl. No.: 13/603,558

(22) Filed: Sep. 5, 2012

(65) Prior Publication Data

US 2013/0065486 A1 Mar. 14, 2013

Related U.S. Application Data

(60) Provisional application No. 61/532,278, filed on Sep. 8, 2011.

(51) Int. Cl.
*A41C 3/00* (2006.01)

(52) U.S. Cl.
CPC ..... *A41C 3/0028* (2013.01); *A41C 3/0064* (2013.01)
USPC ..... 450/59; 450/62; 450/64; 450/86; 450/85

(58) Field of Classification Search
USPC ..... 450/59, 62, 64, 85, 86
See application file for complete search history.

(56) References Cited

U.S. PATENT DOCUMENTS

| | | | | | |
|---|---|---|---|---|---|
| 244,776 | A | * | 7/1881 | Wales | 24/315 |
| 2,553,225 | A | * | 5/1951 | Weaver et al. | 450/59 |
| 2,725,563 | A | * | 12/1955 | Rich | 450/68 |
| 2,800,902 | A | | 7/1957 | Wiltrout | |
| 2,870,768 | A | * | 1/1959 | Robinson | 450/86 |
| 3,400,710 | A | | 9/1968 | Goldstein | |
| 3,439,682 | A | * | 4/1969 | Defru | 450/36 |
| 3,623,487 | A | * | 11/1971 | Chiu | 450/43 |
| 3,710,800 | A | * | 1/1973 | Carey | 450/64 |
| 3,968,803 | A | | 7/1976 | Hyman | |
| 4,022,197 | A | | 5/1977 | Castiglia | |
| 4,024,876 | A | * | 5/1977 | Penrock | 450/48 |
| 4,254,777 | A | | 3/1981 | Johnston | |
| 4,396,013 | A | | 8/1983 | Hasslinger | |
| D273,331 | S | | 4/1984 | Gruber | |

(Continued)

FOREIGN PATENT DOCUMENTS

| | | |
|---|---|---|
| EP | 0 260 351 A1 | 3/1988 |
| EP | 0 368 583 A1 | 5/1990 |

(Continued)

OTHER PUBLICATIONS

May 22, 2003 Search Report for Great Britain Application No. GB 0227838.0 (1 page).

(Continued)

*Primary Examiner* — Gloria Hale
(74) *Attorney, Agent, or Firm* — Popovich, Wiles & O'Connell, P.A.

(57) ABSTRACT

A breast-supportive and breast-positioning brassiere designed to be used postoperatively by patients including obese patients and fuller-sized women who have undergone cardiothoracic surgery that requires a mid-sternal incision (sternotomy). The brassiere is also for other interventions in the thoracic region, when a comfortable and efficient individual positioning and support of the breast(s) would be desirable; an example being to prevent symmastia after breast augmentation surgery. The brassiere prevents gravitation of the breast tissue to the lateral sides, keeps the breast tissue away from the mid center, and supports the weight of the breasts. The brassiere is designed to promote less pain, less wound complications, esthetically improved wound healing, less heat generation, improved wound inspection and access for wound care, while maintaining support and dignity.

15 Claims, 1 Drawing Sheet

(56) References Cited

U.S. PATENT DOCUMENTS

| | | | | |
|---|---|---|---|---|
| 4,630,610 | A | 12/1986 | Fletcher | |
| 4,804,351 | A | 2/1989 | Raml et al. | |
| 4,901,373 | A * | 2/1990 | Broersma | 2/421 |
| 5,037,348 | A | 8/1991 | Farino | |
| 5,098,331 | A | 3/1992 | Corrado | |
| 5,123,121 | A * | 6/1992 | Broersma | 2/421 |
| 5,152,741 | A | 10/1992 | Farnio | |
| 5,221,227 | A | 6/1993 | Michels | |
| 5,242,237 | A * | 9/1993 | Wagner | 402/80 R |
| 5,265,910 | A * | 11/1993 | Barr et al. | 280/808 |
| 5,411,461 | A | 5/1995 | Thomascik | |
| 5,421,809 | A | 6/1995 | Rise | |
| 5,503,620 | A | 4/1996 | Danzger | |
| 5,527,270 | A | 6/1996 | Chase et al. | |
| 5,538,502 | A | 7/1996 | Johnstone | |
| 5,634,439 | A | 6/1997 | O'Brien | |
| 5,797,786 | A | 8/1998 | Smith et al. | |
| 5,839,942 | A | 11/1998 | Miller | |
| 5,843,008 | A | 12/1998 | Gerhard | |
| 6,068,606 | A | 5/2000 | Castel et al. | |
| 6,135,975 | A | 10/2000 | Johnstone | |
| 6,165,045 | A | 12/2000 | Miller et al. | |
| 6,240,564 | B1 | 6/2001 | Te Kanawa | |
| 6,296,618 | B1 | 10/2001 | Gaber | |
| 6,431,947 | B1 | 8/2002 | Henz | |
| 6,460,747 | B1 * | 10/2002 | Tuerschmann et al. | 224/645 |
| 7,056,187 | B2 * | 6/2006 | Cassity | 450/88 |
| 7,144,294 | B2 | 12/2006 | Bell et al. | |
| 7,435,155 | B2 * | 10/2008 | Reinisch et al. | 450/59 |
| 7,666,058 | B2 | 2/2010 | Smith | |
| 7,806,748 | B2 * | 10/2010 | Richardson | 450/61 |
| 7,850,508 | B2 * | 12/2010 | Pitarelli | 450/85 |
| 8,016,640 | B2 * | 9/2011 | Morgan | 450/62 |
| 8,123,588 | B2 * | 2/2012 | Tyrer | 450/86 |
| 2001/0034498 | A1 | 10/2001 | Heyman et al. | |
| 2006/0047236 | A1 | 3/2006 | Hansen | |
| 2011/0251543 | A1 | 10/2011 | Hansen | |

FOREIGN PATENT DOCUMENTS

| | | | |
|---|---|---|---|
| GB | 1 054 741 | A | 1/1967 |
| WO | WO 93/06936 | A1 | 4/1993 |
| WO | WO 99/65428 | A1 | 12/1999 |
| WO | WO 2004/049841 | A2 | 6/2004 |

OTHER PUBLICATIONS

Jun. 14, 2004 Search Report for International Application No. PCT/IB03/06395 (5 pages).

* cited by examiner

POST-OPERATIVE BRASSIERE

CROSS-REFERENCES TO RELATED APPLICATIONS

This application claims the benefit of provisional application Ser. No. 61/532,278, filed Sep. 8, 2011, the contents of which are hereby incorporated herein by reference.

FIELD OF THE INVENTION

The present invention relates to brassieres, and particularly to brassieres used after surgery in the thoracic region. In particular, the present invention relates to a brassiere for individual breast positioning and support to prevent symmastia in patients having undergone surgeries in the breast(s), including, but not limited to, surgeries such as breast augmentation and breast reconstruction. More in particular the present invention relates to a brassiere for surgeries requiring opening of the chest cavity. More in particular, the present invention relates to a brassiere for individual breast positioning and support for patients having undergone surgeries requiring opening of the sternum bone, referred to as a sternotomy. More in particular, the present invention relates to a brassiere for individual breast positioning and support for obese patients and fuller-sized women having undergone surgeries requiring a sternotomy.

BACKGROUND OF THE INVENTION

Following breast surgeries, surgeries inside the chest and in particular surgeries requiring access through the sternum bone (sternotomy), women in general and fuller-sized women in particular, as well as obese patients, encounter additional pain and wound healing complications, caused by the weight of the breast tissue. The mass of breast tissue causes the gravity force to pull the breast tissue downwards when a person is in the standing position and to the lateral sides when a person is in the horizontal position or leaning back. Such pulling force causes significant stress on a fresh surgical wound and in particular on a fresh sternal wound. The two wound edges will be drawn away from each other by the weight pull, and the sutures may break through the skin and wound edges, causing the wound to break open. An open or partially open wound will increase the rate of wound infections, wound deformations, deeper wound rupture and cause additional pain. In an even worse scenario, the pulling force from heavy breast tissue causes the sternum sutures, typically made of stainless steel, to cut into or through the sternum bone. This will cause pain, deep sternal wound infections and sternum dehiscence, which are very severe post operative complications that are very costly to cure.

Therefore breast tissue, and in particular fuller-sized breast tissue, must be positioned and supported to prevent gravity pulling forces in any direction on a wound in the chest and in particular a sternal wound. Simultaneously, as the pulling force is controlled, the breast tissue must not squeeze the wound, and in particular the breast tissue must not squeeze a sternal wound from the lateral sides. Such squeezing pressure on a wound will generate heat and moisture, which both can cause bacterial growth and result in severe infections. Additionally, squeezing a wound, and in particular a sternal wound, disturbs the natural healing process, and the result is deformation of the wound, which leaves an esthetically, unattractive scar in a highly visible place on a patient's chest. This may be a psychological problem for the patient postoperatively, and in particular, it may be a psychological problem for women postoperatively.

Inspection and care of a fresh surgical wound requires access to the wound by opening of the dressings, bands and brassieres, which may cover the wound. This represents particularly a problem for obese patients and fuller sized women, since the support of breast tissue is interrupted during such wound exposure. The gravity force will pull and cause stress on the wound during care, whereby the rate of postoperative complications may increase. Therefore support of the breasts must be maintained at all times during wound inspection and care to prevent such complications and the related increased costs of cure.

A surgical chest dressing is described in U.S. Pat. No. 6,135,975 to Johnstone which incorporates by reference U.S. Pat. No. 3,968,803 to Hyman; U.S. Pat. No. 5,152,741 to Farnio; and U.S. Pat. No. 5,538,502 to Johnstone. The described chest dressing is a brassiere directed towards improved support and comfort of the chest dressings and is "designed to improved support for a patient by holding the breasts of the patient relatively immobile while pressing them slightly toward the line of the incision". However, the surgical chest dressing described is squeezing a patient's side and breast tissue towards the center, whereby a wound in the thoracic area, and in particular a sternal wound, will be exposed to excessive pressure and heat-moist generation from the two breasts being pressed towards each other causing discomfort and pain for a woman with a fresh surgical wound, and in particular for obese and fuller-sized women. Such excessive pressure, heat-moist generation will result in increased potential for wound infections and other complications related to wound healing, as well as scar deformation. These are all complications that will lead to increased health care costs as well.

U.S. Pat. No. 4,804,351 to Rami et al. describes a surgical brassiere directed towards reducing stress along the mid-sternal incision line. The device has a pair of bust support cups and a ventilated panel over the gap between the cups. The ventilated panel can be opened for wound care and discloses how "a pair of inner straps, detachably secured across the gap between the bust support cups, assure that support continues to be provided while the ventilated panel is thus unsecured". However, while the brassiere may remain closed during wound care, there is no means to position the breast tissue to prevent gravitation to the sides, or to prevent the breast cups to squeeze the breast tissue towards the center. This will cause extra pulling stress and/or squeezing on a sternal wound and cause discomfort and pain for a patient, and in particular for obese patients and fuller-sized women. Such wound stress can result in increased infection and complication rates, which will lead to increased health care costs when treating such complications.

U.S. Pat. No. 5,797,786 to Smith et al. describes a post operative brassiere that has been "developed to provide a post-operative brassiere which completely eliminates the conventional torso straps that interconnect the bust support cups so as to form an exposed gap over the area of the patient's mid-sternal incision line to help promote healing and recovery". However, the brassiere has no means to stabilize the breast support cups and prevent gravitation to the sides or to prevent squeezing of the breast tissue towards the center. This will cause pulling stress and/or squeezing on a sternal wound and cause pain and discomfort for a fuller-sized woman, and in particular for obese patients. Such wound stress results in increased infection and complication rates, which will lead to increased health care costs when treating such complications.

Sports bras and brassieres for athletic use generally aim at supporting and immobilizing the breasts to allow women to perform sports activities in a comfortable and painless way. Some of these brassieres are devoted to women with a large bust, such as U.S. Pat. No. 5,221,227 to Michels and U.S. Pat. No. 6,165,045 to Miller et al. Sports brassieres are sometimes employed to patients post-operatively for breast support. However, since they are designed for sports activities, they are generally not suitable for postoperative use and do not meet the specific needs both patients and health care personnel require after surgery.

A brassiere for strenuous physical activity is described in U.S. Pat. No. 4,254,777 to Johnston and shows the use of "extra facings" around the bra cups to prevent undue movement of the breasts. These "facings" have no means to be adjusted and are too thin to give support or direct the position of a breast.

A number of compression brassieres are available for use post-operatively for surgeries such as breast augmentation, reconstructive breast surgeries and other surgeries in the breast(s). Such compression brassieres have drawbacks and are not suitable for postoperative use after interventions inside the thorax, e.g. cardiothoracic surgery, since these devices are designed to compress the breast tissue with the aim to eliminate or reduce swelling caused by accumulation of lymph fluids after a surgical intervention in the breast(s), and/or to press downward newly inserted breast implants. A drawback for cardiothoracic patients using compression brassieres is that the breast tissue is compressed inwards, thereby squeezing and spreading the breast tissue over the thoracic wall in all directions. Such compression is very uncomfortable and painful and may cause healing complications for the wound, and in particular for a sternal wound, which will be exposed to undesirable high pressure and heat-moisture generation. This will increase the rate of wound infections and wound deformations. In particular, such undesirable high pressure on a sternal wound will increase the rate of wound complications in obese patients and for fuller-sized women. All postoperative complications lead to increased health care costs, when they need to be treated.

Examples of prior art for a compression and post-partum breast engorgement bra are described in U.S. Pat. No. 5,839,942 to Miller and other compression devices are disclosed in U.S. Pat. No. 5,098,331 to Corrado; U.S. Pat. No. 5,037,348 to Farino; and U.S. Pat. No. 7,144,294 B2 to Bell et al.

A compression bra is described specifically for symmastia in U.S. Pat. No. 7,666,058 B2 to Smith. This design is directed towards a "compression stabilizing, supporting and positioning bra for addressing and/or correcting synmastia complications in reconstructive breast surgeries . . . " and has a "flared, trapezoidal shaped, sternum compression panel secured at its base to the upper edge of the torso band below the inframammary skinfold and at the top, by a pair of adjustable shoulder straps for elastically compressing sternum tissues while restraining shaping and separating the inside conically rising, side portions of a woman's breasts". While the device described obviously cannot be utilized for patients having had a sternotomy, it aims at "supporting and positioning" the breasts. However, there is no means to prevent gravitation of the breast tissue to the central or the lateral sides. Furthermore, the adjustable shoulder straps that are attached to a panel for elastically compressing the sternum tissue between a woman's breasts only pull a panel upwards and cannot support or direct a breast in any direction.

In view of the foregoing, it is a general object of the present invention to provide a brassiere that can improve the postoperative care and experience for patients, decrease postoperative complications and thereby costs of health care.

A further object of the present invention is to provide a breast-supportive brassiere for obese patients and fuller-sized women who have had surgery in the thoracic region, surgery in the breasts, such as breast augmentation or reconstruction, surgery inside the chest, and in particular surgery that require a mid-sternal incision (sternotomy).

Another object of the present invention is to provide a breast-positioning brassiere for obese patients and fuller-sized women who have had said type of surgeries.

It is yet another object of the present invention to provide a brassiere that prevents gravitation of the patient's breast tissue to the lateral sides when the patient is lying down in a horizontal position or leaning back, in order to prevent pain and complications from weight pull on the wound.

It is yet another object of the present invention to provide a brassiere that prevents the breast tissue of the wearer to be squeezed towards each other centrally, in order to prevent pain and wound healing complications.

It is yet another object of the present invention to provide a brassiere that gives an up-lifting support to the wearer's breast tissue in order to prevent pain and wound healing complications from weight pull on the wound.

It is yet another object of the present invention to provide a brassiere where the position of each breast can be adjusted separately in order to adapt the brassiere optimally to each individual patient's figure.

It is yet another object of the present invention to provide a brassiere that can be adjusted separately for the lateral, the central and the up-lifting support of each breast in order to adapt the brassiere optimally to all various incisions used in different surgeries.

It is yet another object of the present invention to provide a brassiere that maintains the lateral and central support to each breast during wound inspection and care.

It is yet another object of the present invention to provide a brassiere that is easy to open and to close after wound inspection and care.

It is yet another object of the present invention to provide a brassiere that is easy to open in emergency situations that require direct access to the patient's chest.

It is yet another object of the present invention to provide a brassiere that maintains a woman's dignity by keeping the breasts covered during wound inspection and care, which particularly may be an issue for patients of different ethnic origins.

It is yet another object of the present invention to provide a brassiere that is light and does not promote sweating.

It is also an object of the present invention to provide a brassiere that is comfortable to use for the wearer.

SUMMARY OF THE INVENTION

The present invention provides for a brassiere that prevents gravitation of the breast tissue to the lateral sides of the thoracic cavity, keeps the breast tissue away from the mid-center of the chest and supports the weight of the breasts. The brassiere of the present invention is designed to promote less pain, promote less wound complications, esthetically improved wound healing, generate less heat, improve access for wound inspection and for wound care, maintain breast support and maintain dignity for the brassiere wearer.

The present invention provides for a triple-adjuster, which consists of three (3) bra-adjusters arranged in a triangular fashion by using a short, wide, elastic band, thus creating a unique triple-adjuster that is placed above each bra-cup and increasing the flexibility and functionality of the brassiere. The brassiere consists of a pair of soft, comfortable, double-sided, form-cut bra-cups and under-cups, each having a short side panel under each arm. The material used may be uni-directional, stretchable satin, which is chosen for its lightness, softness, strength and availability in aesthetically pleasing colors. The bra-cups and under-cups with side panels are attached to a wide elastic, torso-surrounding, under-bust band, which has a mid-front closure with a fabric hook and loop fastener. The material of the under-bust band may be strong, latex-free elastic, which may be chosen for its soft, cool and gentle feel to the wearer's skin. The same material may be used for all elastic bands in the brassiere.

The present invention provides for two wide elastic, lateral breast-aligners each attached at one end to the under-bust band centrally under each bra-cup. The lateral, longitudinal side of each band is fixed in a stretched mode to the corresponding bra-cup along the arm side of the wearer. The opposite longitudinal side of each aligner band is unattached to the bra-cup. The other end of each lateral aligner is passed through a bra-adjuster on the triple-adjuster, positioned above each bra-cup. The two lateral breast-aligners can thus each be tension-adjusted and closed with fabric hook and loop fasteners to control the position of each breast and prevent gravitation of the breast tissue to the lateral sides.

The present invention additionally provides for two other wide elastic, central breast-aligners each attached with one end to the under-bust band centrally under each bra-cup. The central longitudinal side of each central aligner is fixed in a stretched mode to the corresponding bra-cup along the central mid-bust side. The opposite longitudinal side of each central aligner is unattached to the bra-cup. The other end of each central aligner is passed through a bra-adjuster on the triple-adjuster, positioned just above each bra-cup. The two central breast-aligners can thus each be tension-adjusted and closed with fabric hook and loop fasteners to control the position of the breast to prevent the breast tissue from being squeezed together centrally and to keep a sternal wound free.

The brassiere of the present invention provides for two elastic shoulder straps each attached with one end to the under-bust band and side panel of the bra-cups under each arm. The shoulder straps cross each other at the wearer's back between the shoulder blades, unattached to each other for comfort and flexibility, and enter the front side of the wearer over each shoulder, where the other end of the straps passes through a bra-adjuster on the triple-adjuster. The shoulder straps can be tension-adjusted and closed with fabric hook and loop fasteners to control the up-lift position of the breast for weight support.

The brassiere of the present invention has a second mid-front closure between the two bra-cups. This closure consists of a short elastic band fixed to the upper, central part of the left bra-cup and then passed through a bra-adjuster fixed to the upper, central part of the right bra-cup and closed with fabric hook and loop fastener. The central area between the two front closures creates a natural opening zone for inspection of a sternal wound. When the mid-front, under-bust closure remains closed, and only the upper-front closure between the two bra-cups is opened, the two lateral breast aligners prevent gravitation of the breast tissue to the lateral sides of the patient during wound care. Furthermore, the breast tissue is kept away from the central area between the two breasts by the two central breast aligners during wound care. Thus breast support is maintained and dignity preserved at all times, even with the upper front closure open.

The present invention additionally provides for a chest support including a chest encircling band of stretchable material stretchable along the circumference of the band and first and second breast encapsulating cups. The chest support further includes first and second lateral bands of stretchable material each having two ends, one end of the first lateral band coupled to the chest encircling band under the first breast encapsulating cup, and one end of the second lateral band coupled to the chest encircling band under the second breast encapsulating cup. The chest support further includes first and second central bands of stretchable material each having two ends, one end of the first lateral band coupled to the chest encircling band under the first breast encapsulating cup, and one end of the second lateral band coupled to the chest encircling band under the second breast encapsulating cup. Additionally the chest support includes first and second shoulder straps of stretchable material each having two ends, one end of the first shoulder strap coupled to a back side of the chest encircling band, and one end of the second shoulder strap coupled to the back side of the chest encircling band and first and second adjusters, each adjuster having first, second and third band adjusters. The second end of the first lateral band, the second end of the first central band and the second end of the first shoulder strap are adjustably coupled to the first, second and third band adjusters of the first adjuster. The second end of the second lateral band, the second end of the second central band and the second end of the second shoulder strap are adjustably coupled to the first, second and third band adjusters of the second adjuster.

The chest support may further include that the first and second breast encapsulating cups each have a lateral side panel.

The chest support may include that the first shoulder strap is coupled to the lateral side panel of the first breast encapsulating cup and the second shoulder strap is coupled to the lateral side panel of the second breast encapsulating cup or may include that the first shoulder strap is coupled to the lateral side panel of the second breast encapsulating cup and the second shoulder strap is coupled to the lateral side panel of the first breast encapsulating cup.

The chest support may further include that the first and second breast encapsulating cups each have an under-cup section and the under-cup section of the first and second breast encapsulating cups may further encapsulate 180 degrees around the lower half of each breast. The under-cup section of the first and second breast encapsulating cups may further have a lateral side panel and/or a central front panel.

The first and second breast encapsulating cups of the chest support of the present invention may further have upper and lower section and may further include that the material of the upper section is cut in a transversal direction and the material of the lower section is cut in a longitudinal direction.

The chest support may further include that the first breast encapsulating cup is coupled to the second breast encapsulating cup by a front band and may further include that the front band has a central adjuster to adjustably couple the first breast encapsulating cup to the second breast encapsulating cup and/or that the central front band has a central closure.

DETAILED DESCRIPTION OF PREFERRED EMBODIMENTS

Figure 1:
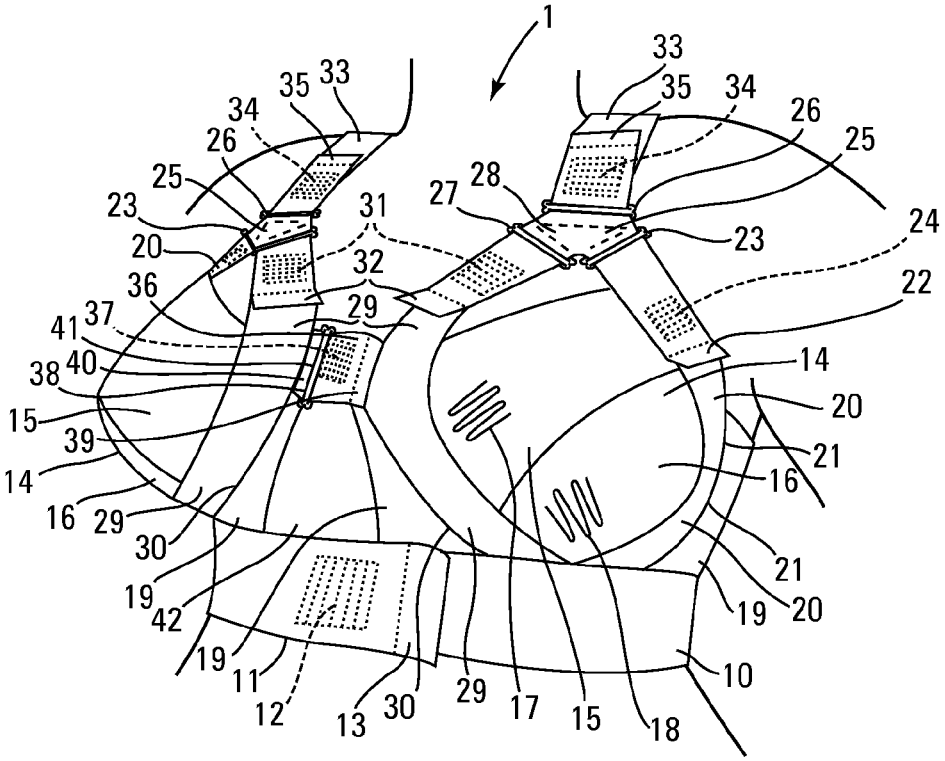
FIG. 1 is a front view, from an angle slightly to the left side of the wearer, of a brassiere in accordance with an embodiment of the present invention.

Referring to FIG. 1, brassiere 1 has an elastic under-bust band or chest encircling band 10 that is torso encircling and positioned below the wearer's breasts. As will be described in more detail below, brassiere 1 is provided with multiple independent adjustment features that allow the brassiere to be adjusted to maximize the comfort of the wearer and promote wound healing while allowing access for post operative inspection and care. Brassiere 1 further provides the wearer with bare back exposure reducing the overall weight of the brassiere and allowing body heat to escape thus reducing the amount of sweating from the wearer that may cause further discomfort or irritation. It should be noted that depending upon the application brassiere 1 could be worn as an under garment brassiere for comfort and support and that brassiere 1 is not limited to post operative use. The under-bust band or chest encircling band 10 may have a mid-front closure 11 with conventional fabric hook and loop fasteners 12 that can be adjusted over a range of at least 3 inches. The closure may have a grasping fold 13 for comfort and to make it easier for the wearer or health care staff to open and close the fabric hook and loop fastener on the under-bust band 10. Grasping fold 13 may be created by making a 0.5 inch fold of the elastic material before attaching the fabric hook material at the end of the under-bust band 10. Preferably the material of the under-bust band 10 is latex-free and elastic with a very soft, cool feel to the skin for comfort but it should be noted that the under-bust band 10 may be made of any desirable material depending upon the application. Under-bust band 10 may have a width of at least 2.5 inches but may be wider or narrower depending upon the application.

Brassiere 1 may have two breast encapsulating bra-cups 14 that may be made from a uni-directional, stretchable, strong satin and may be form cut. It should be understood that the material is not limiting and that any suitable material could be used depending upon the application. Each bra-cup 14 may consist of an upper section 15 and lower section 16, which are cut to form an encapsulating bra-cup 14 when they are stitched together. Upper section 15 of encapsulating bra-cup 14 may be cut with the uni-direction of material in a transversal direction 17 and lower section 16 of the encapsulating bra-cup 14 may be cut with the uni-direction of material in a longitudinal direction 18 so that each encapsulating bra-cup 14 will assist with the positioning and support of the breast.

Figure 2:
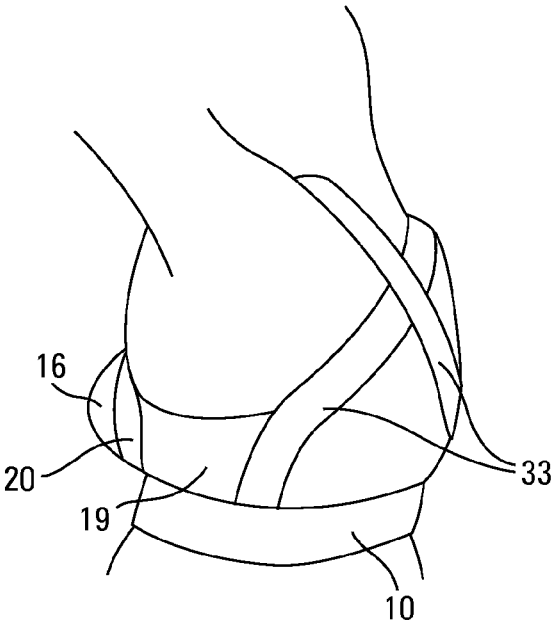
FIG. 2 is a back view, from an angle slightly to the left side of the wearer, of a brassiere in accordance with an embodiment of the present invention.

Breast encapsulating bra-cup 14 may have an under-cup section 19 that may be form cut and may be located 180 degrees around the lower half of each breast and positioned flat against the chest wall. Each under-cup section 19 may have a side panel reaching under the arm as best seen in FIG. 2. Brassiere 1 may be optionally provided in back with an additional band (not shown) that is attached from one side panel to the other side panel parallel to under bust band 10 for further stabilization and support especially in larger sized brassieres. Under cups 19 attached to each bra-cup 14 may be separately fixed or coupled to the under-bust band 10 on opposite sides of the mid front closure 11. Brassiere 1 may have double-sided bra-cups 14 and double-sided under-cups 19 with the stitched seam sides turned against each other, so there are no seams touching the skin of the wearer for additional comfort.

Brassiere 1 has elastic lateral bands 20 each having two ends and each having one end fixed or coupled to the under-bust band 10 centrally underneath each of the bra cups 14. The lateral longitudinal side 21 of each lateral band 20 may be stitched to the lateral side of under-cup 19 along the junction of bra-cup 14. Each band 20 may be stitched to under-cup 19 in a 50% stretched mode to add additional support. The opposite longitudinal side of lateral bands 20 may be un-attached to the bra-cup 14. The second end of each of the two lateral bands 20 may have a fabric hook and loop fastener 24, or any other suitable fastener, arranged with the loop part followed by the hook part, the hook part being positioned close to the end of each of the lateral bands 20. Lateral bands 20 each are passed through bra-adjusters 23, so the hook part of the fabric hook and loop fastener 24, can be adjustably closed upon the loop part after tension adjustment of bands 20.

Lateral bands 20 may have grasping fold 22 at the end for comfort and to make it easier for the wearer or the health care staff to open and close the fabric hook and loop fastener of lateral bands 20. Grasping fold 22 is created by making a 0.5 inch fold of the elastic material before attaching the fabric hook material at the end of the bands 20. The material of lateral band 20 may be latex-free and elastic with a very soft, cool feel to the skin for comfort. Bands 20 may have a width of at least 1.5 inches and the width of lateral bands 20 may be increased in accordance with the size of the bra-cup 14. It should be noted that materials and dimensions are not limiting and the bands 20 may be made of any desired material and may have any desired width depending upon the application.

Brassiere 1 has elastic central bands 29 each having two ends with one end of each elastic central band 29 being fixed or coupled to the under-bust band 10 centrally underneath each of the bra cups 14. The central longitudinal side 30 of each central band 29 may be stitched to the central side of under-cup 19 along the junction to bra-cup 14. Each central band 29 may be stitched to the under-cup 19 in a 50% stretched mode to add additional support. The opposite longitudinal side of the two elastic bands 29 may be unattached to bra-cup 14. The other of the two ends of each of the two central bands 29 may have fabric hook and loop fastener 31, or any other suitable fastener, arranged with the loop part followed by the hook part, where the hook part is positioned last before the end of each of the central bands 29. Central bands 29 are each passed through bra-adjusters 27 so the hook part of the fabric hook and loop fastener 31, can be closed upon the loop part after tension adjustment of the bands 29.

Central bands 29 each may have a grasping fold 32 at the end for comfort and to make it easier for the wearer or the health care staff to open and close the fabric hook and loop fastener of central bands 29. The grasping fold may be created by making a 0.5 inch fold of the elastic material before attaching the fabric hook material at the end of the band 29. The material of central band 29 may be latex-free and elastic with a very soft, cool feel to the skin for comfort. Central band 29 may have a width of at least 1.5 inches, and the width of elastic band 29 may be increased in accordance with the size of the bra-cup 14. It should be noted that materials and dimensions are not limiting and bands 29 may be made of any desired material and may have any desired width depending upon the application.

Figure 3:
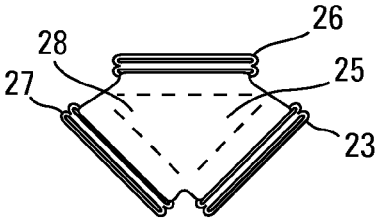
FIG. 3 is a view of the triple bra-adjuster in accordance with an embodiment of the present invention.

Brassiere 1 has two triple adjusters 25 positioned above each of the bra-cups 14. Each adjuster 25 consists of three bra-adjusters 23, 26 and 27 that are arranged in a triangle by using elastic band 28 that passes through each bra-adjuster 23, 26 and 27, as best seen in FIG. 3. Elastic band 28 may have short and wide dimensions and may more specifically have a width of at least 1.5 inches. The width of the elastic band 28 may be increased in accordance with the size of lateral bands 20 and central bands 29, as bands 20 and 29 are increased in accordance with the size of the bra-cup 14. Bra-adjusters 23, 26 and 27 may have two parallel closed loops and may be made of metal covered with non-allergic polyamide. The size of the bra-adjuster 23, 26 and 27 may be increased in accordance with the size of the bra-cup 14. It should be noted that the size and material of the adjuster and bra-adjusters are not limiting and any suitable size or material may be used.

Brassiere 1 has two elastic shoulder straps 33 each having two ends and each shoulder strap 33 having one end attached to the back side of the under-bust band 10 and additionally may be attached to the side panel of the under cups 19 of encapsulating bra cup 14. The shoulder straps 33 may cross each other at the wearer's back between the shoulder blades without being attached to each other, and preferably may enter the front side of the wearer over each shoulder, as best seen in FIG. 2. The other end of each of the two shoulder straps 33 may have a fabric hook and loop fastener 34, or any other suitable fastener, arranged with the loop part followed by the hook part, where the hook part is positioned last before the end of each of the shoulder straps 33. The shoulder straps 33 each are passed through bra-adjusters 26 so the hook part of the fabric hook and loop fastener 34 can be closed upon the loop part after tension adjustment of shoulder straps 33.

Shoulder straps 33 may each have a grasping fold 35 at the end for comfort and to make it easy for the wearer or the health care staff to open and close the fabric hook and loop fastener of the shoulder straps 33. Grasping fold 35 may be created by making a 0.5 inch fold of the elastic material before attaching the fabric hook material at the end of the shoulder straps 33. The material of shoulder straps 33 may be latex-free and elastic with a very soft, cool feel to the skin for comfort. The shoulder straps 33 may have a width of at least 1.5 inches. It should be noted that materials and dimensions are not limiting and shoulder straps 33 may be made of any desired material and may have any desired width depending upon the application.

Brassiere 1 may have a front band that may have a second mid-front closure 37 coupled to the two encapsulating bra-cups 14. Mid-front closure 37 may have a short elastic band 40 that may be passed through bra-adjuster 38 and stitched in a line 41 transversally along the band as close as possible to the bra-adjuster 38. Band 40 may be cut at least 0.25 inch from the stitch line 41 and band 40 may be stitched to the upper, central part of the right-sided under-cup 19 at the junction to bra-cup 14.

Brassiere 1 may also have elastic band 36 having two ends with one of the ends stitched to the upper, central part of the left-sided under-cup 19 at the junction to the bra-cup 14. The other of the two ends of band 36 has fabric hook and loop fastener 37, or any other suitable fastener, arranged with the loop part followed by the hook part, where the hook part is positioned last before the end of the band 36. Band 36 is passed through bra-adjuster 38, so the hook part of the fabric hook and loop fastener 37 can be closed upon the loop part to close the band 36. Band 36 may have a grasping fold 39 at the end for comfort and to make it easy and quick for the wearer or the health care staff to open and close the fabric hook and loop fastener of the band 36. Grasping fold 39 may be created by making a 0.5 inch fold of the elastic material before attaching the fabric hook material at the end of the band 36. The material of bands 40 and 36 may be latex-free and elastic with a very soft, cool feel to the skin for comfort. Bands 40 and 36 may have a width of at least 1.5 inches and the width of the bands 40 and 36 may be increased in accordance with the size of the bra-cup 14. Bra-adjuster 38 is of the type that has two parallel, closed loops and may be made of metal covered with non-allergic polyamide. The size of the bra-adjuster 38 may be increased in accordance with the size of the bands 40 and 36. It should be noted that materials and dimensions are not limiting and the bands 40 and 36 as well as bra-adjuster 38 may be made of any desired material and may have any desired width or size depending upon the application.

Brassiere 1 may have an open central area 42 between the two mid front closures 11 and 37 which may serve as a natural opening zone for inspection of a sternal wound. The form cutting of the under-bust cup 19 may create the open area 42.

The above description and the drawings are provided for the purpose of describing embodiments of the invention and are not intended to limit the scope of the invention in any way. It will be apparent to those skilled in the art that various modifications and variations can be made without departing from the spirit or scope of the invention. Thus, it is intended that the present invention cover the modifications and variations of this invention provided they come within the scope of the appended claims and their equivalents. Further, while choices for materials and configurations may have been described above with respect to certain embodiments, one of ordinary skill in the art will understand that the materials and configurations described are applicable across the embodiments.

What is claimed is:

1. A chest support comprising:

a chest encircling band of stretchable material stretchable along the circumference of the band;

first and second breast encapsulating cups;

first and second lateral bands of stretchable material each having two ends, one end of the first lateral band fixedly coupled to the chest encircling band under the first breast encapsulating cup, and one end of the second lateral band fixedly coupled to the chest encircling band under the second breast encapsulating cup, the first and second lateral bands each having an adjustable attachment member including a first part adjacent the second end and a second part positioned between the first part and the first end, the first part being adjustably attachable to the second part;

first and second central bands of stretchable material each having two ends, one end of the first lateral band fixedly coupled to the chest encircling band under the first breast encapsulating cup, and one end of the second lateral band fixedly coupled to the chest encircling band under the second breast encapsulating cup, the first and second central bands each having an adjustable attachment member including a first part adjacent the second end and a second part positioned between the first part and the first end, the first part being adjustably attachable to the second part;

first and second shoulder straps of stretchable material each having two ends, one end of the first shoulder strap fixedly coupled to a back side of the chest encircling band, and one end of the second shoulder strap fixedly coupled to the back side of the chest encircling band, the first and second shoulder straps each having an adjustable attachment member including a first part adjacent the second end and a second part positioned between the first part and the first end, the first part being adjustably attachable to the second part;

first and second adjusters, each adjuster having first, second and third openings;

wherein the first lateral band is received in one of the first, second and third openings of the first adjuster at a selectable location between the first and second ends of the first lateral band when the first and second parts are adjustably attached to provide tension adjustment of the first lateral band, the first central band is received in one of the first, second and third openings of the first adjuster at a selectable location between the first and second ends of the first central band when the first and second parts are adjustably attached to provide tension adjustment of the first central band and the first shoulder strap is received in one of the first, second and third openings of the first adjuster at a selectable location between the first and second ends of the first shoulder strap when the first and second parts are adjustably attached to provide tension adjustment of the first shoulder strap; and wherein the second lateral band is received in one of the first, second and third openings of the second adjuster at a selectable location between the first and second ends of the second lateral band when the first and second parts are adjustably attached to provide tension adjustment of the second lateral band, the second central band is received in one of the first, second and third openings of the second adjuster at a selectable location between the first and second ends of the second central band when the first and second parts are adjustably attached to provide tension adjustment of the second central band and the second shoulder strap is received in one of the first, second and third openings of the second adjuster at a selectable location between the first and second ends of the second shoulder strap when the first and second parts are adjustably attached to provide tension adjustment of the second shoulder strap.

2. A chest support of claim 1 wherein the first and second breast encapsulating cups each have a lateral side panel.

3. A chest support of claim 2 wherein the first shoulder strap is coupled to the lateral side panel of the first breast encapsulating cup and the second shoulder strap is coupled to the lateral side panel of the second breast encapsulating cup.

4. A chest support of claim 2 wherein the first shoulder strap is coupled to the lateral side panel of the second breast encapsulating cup and the second shoulder strap is coupled to the lateral side panel of the first breast encapsulating cup.

5. A chest support of claim 1 wherein the first and second breast encapsulating cups each have an under-cup section.

6. A chest support of claim 5 wherein the under-cup section of the first and second breast encapsulating cups encapsulate 180 degrees around the lower half of each breast.

7. A chest support of claim 5 wherein the under-cup section of the first and second breast encapsulating cups have a lateral side panel.

8. A chest support of claim 5 wherein the under-cup section of the first and second breast encapsulating cups have a central front panel.

9. A chest support of claim 1 wherein the first and second breast encapsulating cups have upper and lower sections.

10. A chest support of claim 9 wherein the material of the upper section is cut in a transversal direction and the material of the lower section is cut in a longitudinal direction.

11. A chest support of claim 1 wherein the chest encircling band has an adjustable central front closure.

12. A chest support of claim 1 wherein the first breast encapsulating cup is coupled to the second breast encapsulating cup by a front band.

13. A chest support of claim 12 wherein the front band has a central adjuster to adjustably couple the first breast encapsulating cup to the second breast encapsulating cup.

14. A chest support of claim 12 wherein the central front band has a central closure.

15. A chest support device comprising:

a chest encircling band of stretchable material stretchable along the circumference of the band;

first and second breast encapsulating cups;

first and second lateral bands of stretchable material each having two ends, one end of the first lateral band fixedly coupled to the chest encircling band under the first breast encapsulating cup, and one end of the second lateral band fixedly coupled to the chest encircling band under the second breast encapsulating cup;

first and second central bands of stretchable material each having two ends, one end of the first lateral band fixedly coupled to the chest encircling band under the first breast encapsulating cup, and one end of the second lateral band fixedly coupled to the chest encircling band under the second breast encapsulating cup;

first and second shoulder straps of stretchable material each having two ends, one end of the first shoulder strap fixedly coupled to a back side of the chest encircling band, and one end of the second shoulder strap fixedly coupled to the back side of the chest encircling band;

first tension adjusting means for independently adjusting the tension of each of the first lateral band, first central band and first shoulder strap; and second tension adjusting means for independently adjusting the tension of each of the second lateral band, second central band and second shoulder strap.

* * * * *